US009028308B2

(12) United States Patent
Bastow

(10) Patent No.: US 9,028,308 B2
(45) Date of Patent: May 12, 2015

(54) INTEGRATED STRUCTURAL SLAB AND ACCESS FLOOR HVAC SYSTEM FOR BUILDINGS

(76) Inventor: Philip A. J. Bastow, Toronto (CA)

( * ) Notice: Subject to any disclaimer, the term of this patent is extended or adjusted under 35 U.S.C. 154(b) by 1999 days.

(21) Appl. No.: 11/639,259

(22) Filed: Dec. 15, 2006

(65) Prior Publication Data

US 2008/0142610 A1 Jun. 19, 2008

(51) Int. Cl.
*F24F 7/08* (2006.01)
*F24D 5/10* (2006.01)
*F24F 3/052* (2006.01)

(52) U.S. Cl.
CPC . *F24D 5/10* (2013.01); *F24F 3/052* (2013.01); *F24F 2221/40* (2013.01)

(58) Field of Classification Search
USPC ..... 454/186; 52/220.1
See application file for complete search history.

(56) References Cited

U.S. PATENT DOCUMENTS 4,227,566 A * 10/1980 Stilber ..... 165/45
4,775,001 A 10/1988 Ward
5,121,789 A * 6/1992 Scharfe ..... 165/48.2
5,468,184 A * 11/1995 Collier ..... 454/186
6,033,301 A 3/2000 Suwa
6,209,330 B1 4/2001 Timmerman
6,361,432 B1 3/2002 Walker
2003/0150231 A1 8/2003 Spinazzola
2003/0209023 A1 11/2003 Spinazolla
2004/0118137 A1 6/2004 Patel
2004/0141542 A1 7/2004 Sharma
2004/0198214 A1 10/2004 Karidis

* cited by examiner

*Primary Examiner* — Steven B McAllister
*Assistant Examiner* — Samantha Miller
(74) *Attorney, Agent, or Firm* — Eugene Gierczak

(57) ABSTRACT

A heat exchange and ventilation system integrated with a hollow core concrete floor having an air passage therethrough with an inlet and outlet for receiving air and permitting relative heat exchange therebetween; a raised floor supported by said hollow core concrete floor, defining a floor plenum between said hollow core concrete floor and said raised floor, said floor plenum communicating with said outlet so as to receive air from said air passage through said hollow core concrete floor; and adjustable terminal means carried by said raised floor for delivering a portion of said air from said floor plenum into a space above said floor. A method of conditioning air through a hollow core medium supporting a raised floor is also disclosed.

16 Claims, 5 Drawing Sheets

INTEGRATED STRUCTURAL SLAB AND ACCESS FLOOR HVAC SYSTEM FOR BUILDINGS

FIELD OF INVENTION

This invention relates to a heat exchange and ventilation system with a raised floor supported by a hollow core concrete floor and includes the method of conditioning air through a hollow core medium supporting a raised floor.

BACKGROUND TO THE INVENTION

Many prior art devices and methods have heretofore been designed for heating, ventilating and air conditioning (HVAC) systems.

Some of the HVAC systems have been designed for raised access floor systems. Other HVAC systems have been designed for hollow core slab systems.

Raised access floor systems generally comprise a series of spaced apart pedestals which are supported at the lower end thereof on a concrete floor while the upper end thereof supports a series of panels defining a raised floor. The space between the said raised floor and concrete floor defines a cavity or floor plenum. For example, U.S. Pat. No. 4,775,001 relates to the design of air terminal devices used in raised floor air supply plenum systems while U.S. Pat. No. 6,209,330 relates to an air handler based on chilled water as the cooling source for cooling computer rooms.

Under floor air distribution systems using the floor plenum of the raised access floor as a supply air pathway is a proven technology and growing significantly in the North America market place. The most current versions of raised access floors utilize infloor air terminals which are either manually or automatically adjustable and control the amount of air delivered to the occupancy above the floor from a lightly pressurized infloor plenum. The terminals or diffusers are generally pressure dependent and deliver predictable air flow based on stable infloor pressure whereby the volume of air to the occupied space is a function of the floor plenum air pressure and the number of infloor terminals and their open status. This pressure is maintained as a constant by infloor pressure sensors providing information to the building control system to control the speed of the fan delivering air to the floor plenum all in a manner well known to persons skilled in the art. The fan volume generally varies to keep the pressure maintained.

Hollow core/slab integrated ventilation air conditioning and heating technology and applications are also well known and widely used in Scandinavian countries. For example U.S. Pat. No. 4,124,062 relates to a system of passing air from outside a building through channels in a concrete floor so as to cool the concrete thereby storing the coolness which is then transferred to the room in the following day. Furthermore U.S. Pat. No. 4,830,275 relates to temperature control of buildings having prefabricated hollow concrete slabs or concrete floor structures with cast in ducts where cooled supply air flows through the floor structure before it is supplied by way of supply air device to the room unit on the floor.

Generally speaking these hollow core slab structures are thermally charged by running warm or cold air through the hollow cores to set their thermal mass at a temperature capable of radiating or absorbing heat to and from the occupied space. In addition, the air running through the slab is released into the space to further support heating or more often a cooling mode of operation. The majority of these systems are applied with the active hollow core located above the occupancy at the ceiling. At the ceiling and in the cooling mode the slab provides a cold radiant effect to the space below as well as absorbing heat build up from the space through convection between room air and the hollow core slabs. Such systems have good thermal inertial and mass thermal storage/absorption capabilities.

Furthermore it is known that the under floor and hollow core technologies have been combined. However, such combination did not allow the hollow core slab supporting the raised floor to release the air carried through its core into the raised floor supply air plenum.

It is an object of this invention to provide an improved heat exchange and ventilating system.

DISCLOSURE OF INVENTION

It is an aspect of this invention to provide a heat exchange and ventilation system comprising a hollow core concrete floor having an air passage therethrough with an inlet and outlet for receiving air and permitting relative heat exchange therebetween; a raised floor supported by said hollow core concrete floor, defining a floor plenum between said hollow core concrete floor and said raised floor, said floor plenum communicating with said outlet so as to receive air from said air passage through said hollow core concrete floor; and adjustable terminal means carried by said raised floor for delivering a portion of said air from said floor plenum into a space above said floor.

Another aspect of this invention relates to a thermally charged slab in an occupied space above the raised floor; either as a repeat of said slab plenum system from a floor above, or a thermally charged hollow core roof slab, or another form of thermally charged roof structure.

It is a further aspect of this invention to provide an air conditioning system for at least one room on at least one floor in a building, comprising: at least one hollow core concrete floor section having an air passage therethrough with an inlet and outlet; at least one raised floor section supported by said at least one hollow core concrete floor section; at least one floor plenum defined between said at least one hollow core concrete floor section and said at least one raised floor section for communicating with said outlet; fan means communicating with said inlet for blowing said air through said passage, outlet, and floor plenum and permitting relative heat exchange between said air and said at least one hollow core concrete floor section; at least one terminal means disposed in said at least one raised floor section for presenting a selected volume of air from said floor plenum to a space above said raised floor segment in said room, said terminal means responsive to pressure.

It is yet another aspect of this invention to provide a method of conditioning air through a hollow core medium supporting a raised floor comprising passing said air through said hollow core medium to effect relative heat exchange therebetween; releasing said air from said hollow core medium into a floor plenum defined between said hollow core medium and said raised floor.

BEST MODE FOR CARRYING OUT THE INVENTION

Figure 1:
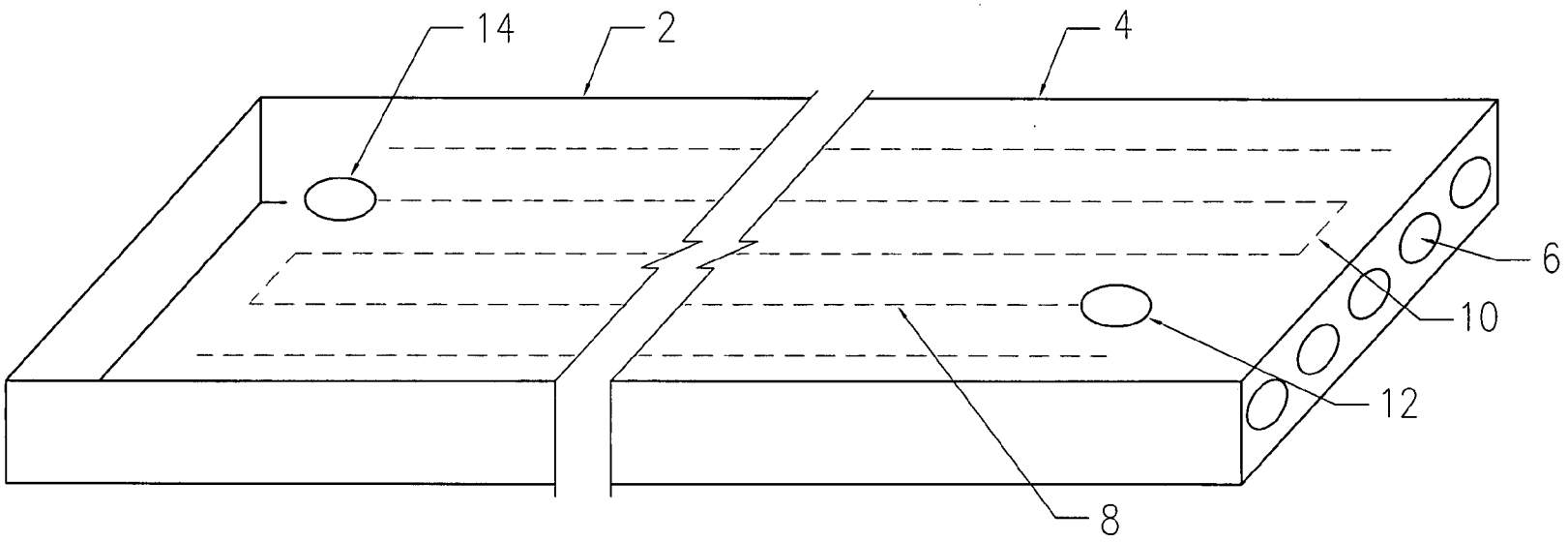
FIG. 1 is a representation of a hollow core internal air circuit.

In the description which follows, like parts are marked throughout the specification and the drawings with the same respective reference numerals. The drawings are not necessarily to scale and in some instances proportions may have been exaggerated in order to more clearly depict certain features of the invention.

Figure 5:
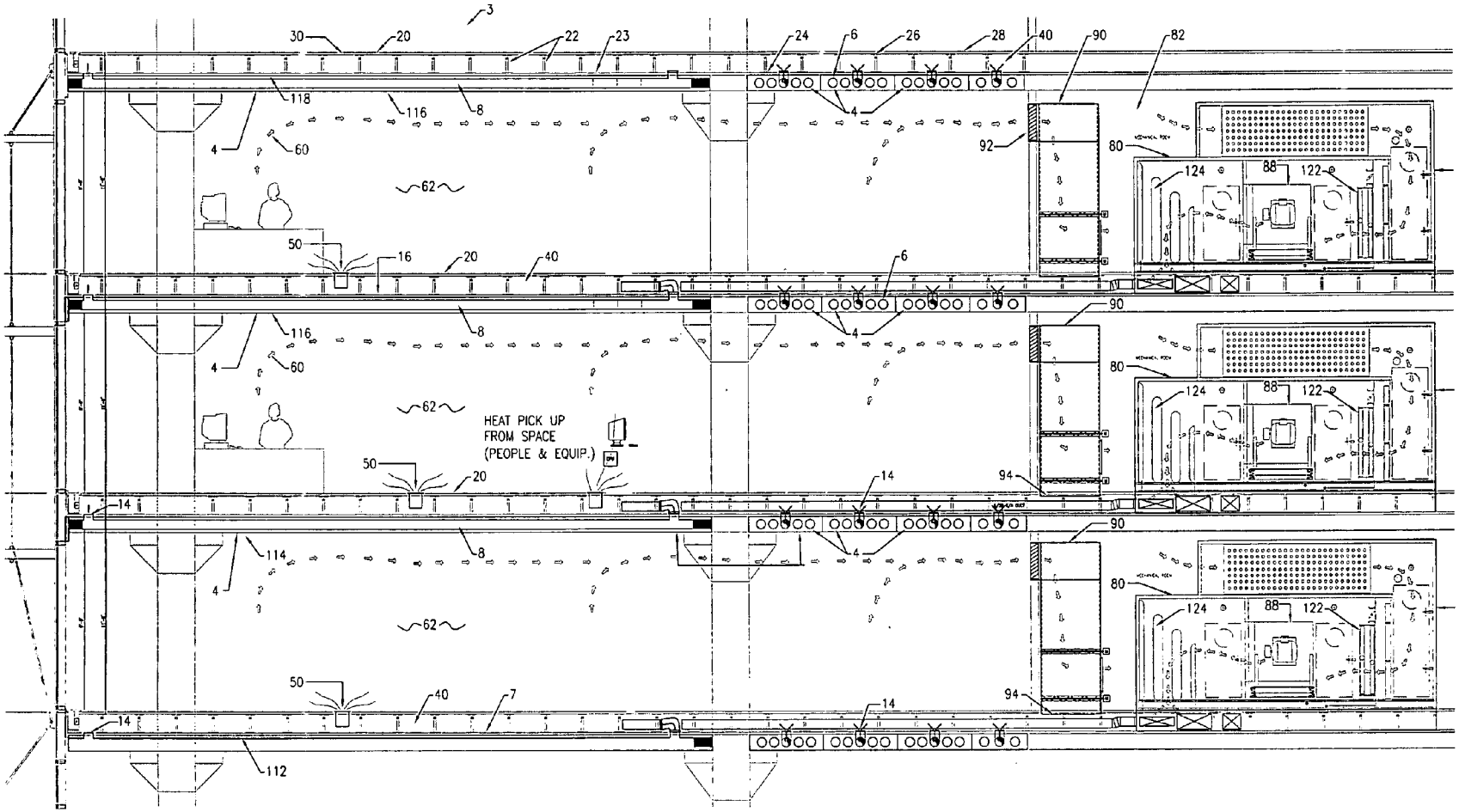
FIG. 5 is a representative view partial cut side elevational view illustrating the invention between three floors in a building.

FIG. 1 generally illustrates a hollow core medium 2 which is generally used in constructing a floor 3 in a building 5, as shown in FIG. 5.

The most commonly used hollow core medium 2 comprises a hollow core concrete floor slab 4 as shown in FIG. 1. The hollow core concrete floor slab 4 is comprised of concrete having a plurality of generally parallel hollow cores 6. The hollow cores 6 can be linked as shown to produce air bridges 10 so as to thereby define a passage 8 which is adapted to receive air therethrough. The passage of the hollow core concrete floor slab 4 includes an air inlet 12 and an air outlet 14. The air bridges 10 link the cores 6.

Figure 2:
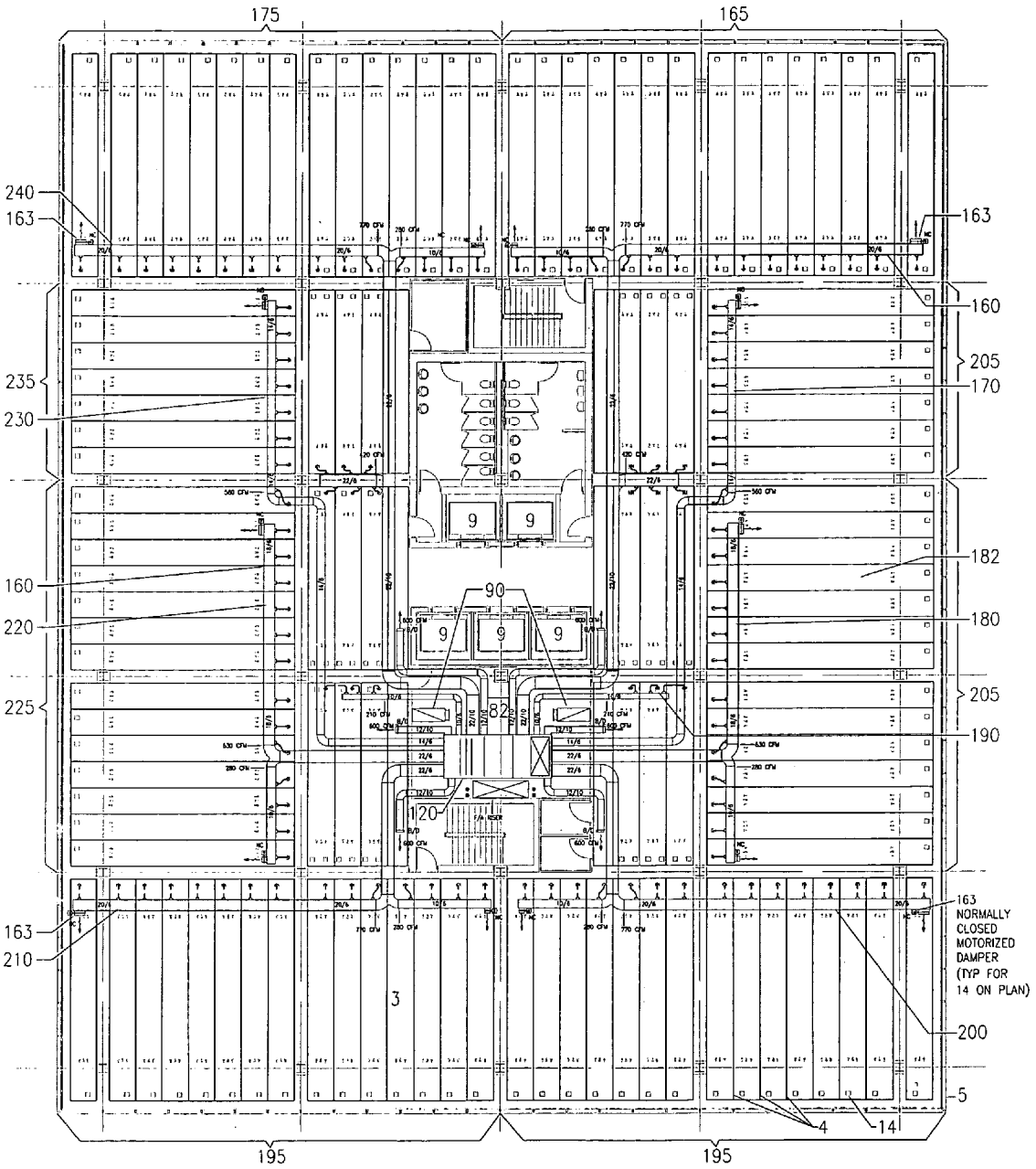
FIG. 2 is a top plan view of a floor in a building utilizing the invention described herein.

A plurality of hollow core concrete floor slabs 4 can be joined together in a manner well known to those persons skilled in the art so as to fabricate the floor 3 of a building 5 as shown in FIG. 2.

FIG. 5 best illustrates the raised floor 20 which is supported by the hollow floor concrete floor slabs 4. The raised floor 20 includes a plurality of spaced apart pedestals 22 which contact the hollow floor concrete floor 23 at the lower ends 24 thereof. In some cases there may be a concrete layer 7 or topping on top of the hollow core 4 to keep them fixed and more structurally sound as a floor structure so that the raised floor would actually sit on the topping. By way of example only the topping may be approximately 2 inches thick.

The upper ends 26 of the pedestals 22 generally speaking support a plurality of panels 28 so as to define a floor surface 30. An air or floor plenum 40 is defined between the hollow core concrete floor slab 4 and the raised floor 30. The floor plenum 40 communicates with the outlet 14 of the concrete slab 4 so as to receive air from the air passage 8 passing through the hollow core concrete floor slab 4.

As the air passes through the passage 8 in the hollow core concrete floor slab 4 relative heat exchange occurs there between. For example, the hollow core concrete floor slab 4 could act as a heat sink absorbing heat during the day generated in the occupied space 62 and thereby heating the cooler air as it passes through the passage 8 therethrough. Alternatively, the hollow core concrete floor slab 4 can act as a heat source giving off heat to a cooler occupied space 62 and thereby absorbing heat in warmer air as it passes through the passage 8.

Figure 3:
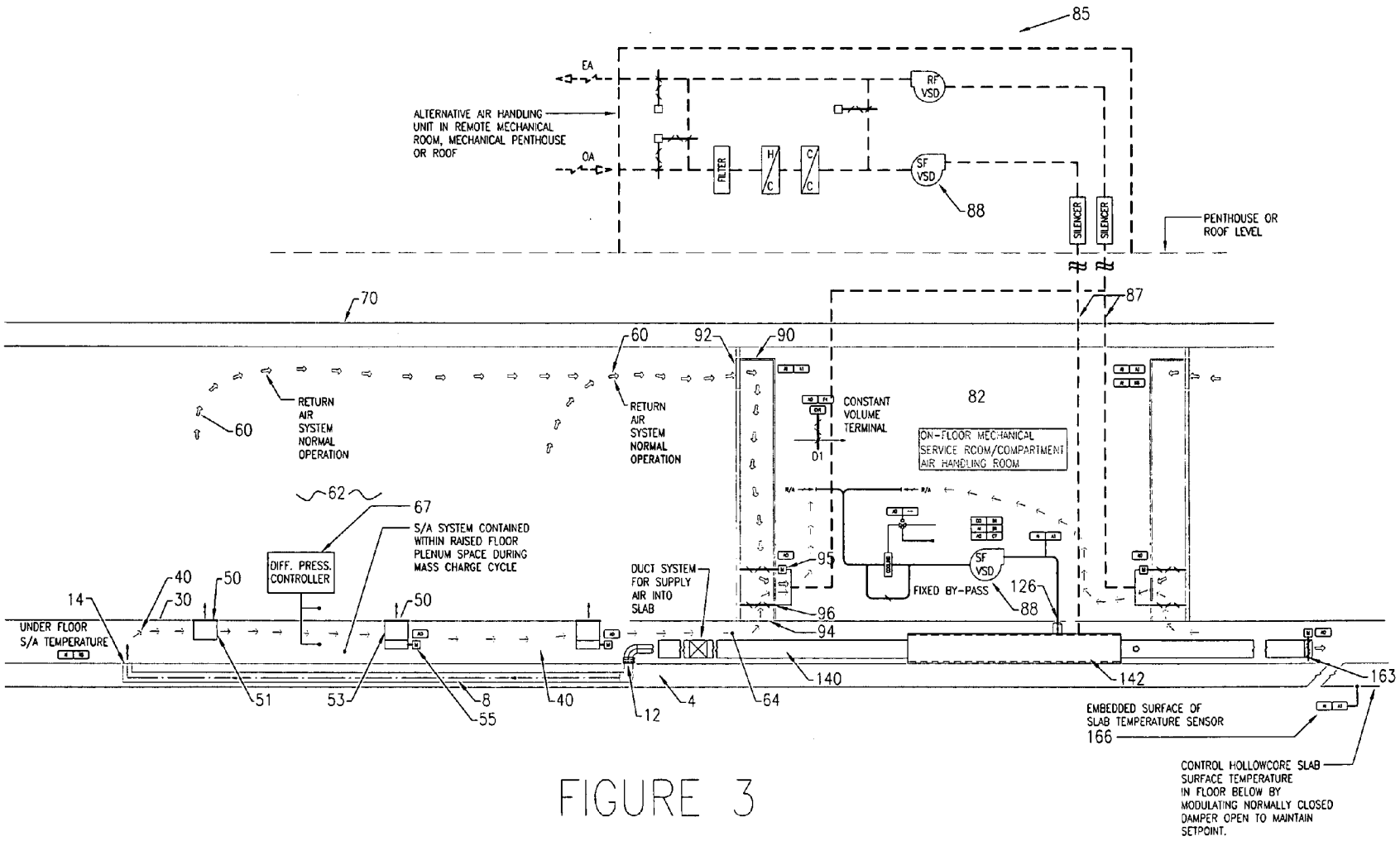
FIG. 3 is a schematic representative side elevational view of the invention described herein.

The raised floor 30 can include a plurality of terminal means 50 for delivering a portion 60 of air from said floor plenum 40 into a space 62 above the floor surface 30 as shown in FIGS. 3 and 5. The terminal means 50 can comprise of any device which permits a selected amount of air to pass therethrough. For example terminal means 50 can comprise of a diffuser or terminal which is manually or automatically adjustable. The terminal or diffuser is located in a hole created in the raised floor designed to receive the diffuser or terminal.

Accordingly the heat exchange and ventilating system 70 comprises a hollow core concrete floor slab 4 having an air passage 8 therethrough with an inlet 12 and an outlet 14 for receiving air and permitting relative heat exchange there between; a raised floor 20 supported by the hollow core concrete floor slabs 4 defining a floor plenum 40 between the hollow core concrete floor slabs 4 and the raised floor 20, whereby the floor plenum 40 communicates with the outlet 14 so as to receive air from the air passage 8 through the hollow core concrete floor slab 4; and the adjustable terminal means 50 which are carried by the raised floor 30 for delivering a portion 60 of the air from the floor plenum 40 into a space 62 above the floor surface 30. Any portion 60 of air from 0% to 100% can be delivered to the space 62. Generally speaking however, 50% to 90% is delivered to the occupied space 62.

The heat exchange and ventilating system 70 also includes an air handler 80. The air handler 80 can include a fan, cooling coils or other devices known to people skilled in the art. The air handler 80 can be located anywhere and connected by means of supply and return ductwork. One example of an air handler 80 is shown in FIG. 5 for blowing air through the system 70 in a manner to be more fully described herein. The air handler 80 in the example shown in FIG. 5 is located in a mechanical service room 82 or in another example in a convenient location on a floor as shown in FIG. 3.

The heat exchange and ventilating system 70 includes a return damper assembly 90. The return damper assembly 90 is generally disposed vertically relative to the floor surface 30 and includes an upper opening 92 for receiving the portion of air from 60 in the space 62 above the floor surface 30. The return damper assembly 90 also includes a lower opening 94 for receiving the remaining air 64 in the floor plenum 40. The upper and lower opening can include a damper or moveable baffle that is displaceable so as to selectively open or close the opening any selected degree in a manner well known to persons skilled in the art. The remaining air 64 is the air that remains in the plenum 40 (excess air) after the portion of air 60 has been vented to the space 62 above the floor surface 30.

The return damper assembly means 90 communicates with the air handler 80 so as to recirculate the portion of air 60 and the remaining air 64 back to the air handler 80 that will supply it back to the hollow core concrete floor slab 4.

The return damper assembly means 90 may be a stand alone unit located in a mechanical room 82 which communicates with a standard HVAC unit as shown in FIG. 5. Alternatively, the return damper assembly means can be a part of a compartment unit air handling equipment 120 which can be located in a mechanical room 82 which is shown in hidden lines in FIG. 4. The compartment unit air handling equipment 120 can include cooling coils 122 for cooling air passing therethrough as well as a silencer 124 for silencing the unwanted levels of noise that can invade the occupied space 62. In other words the air damper assembly means 90 can comprise an independent device that controls the return air path to release its air into the mechanical service room/compartment unit 81 under negative pressure from a fan in a compartment unit 120 or being directly integrated, or an integrated part of a compartment unit for assembly or air handling as previously described.

The return damper assembly 90 includes the upper opening 92 as previously described for receiving the portion 60 of air in the space 62 above the floor surface 30.

Figure 4:
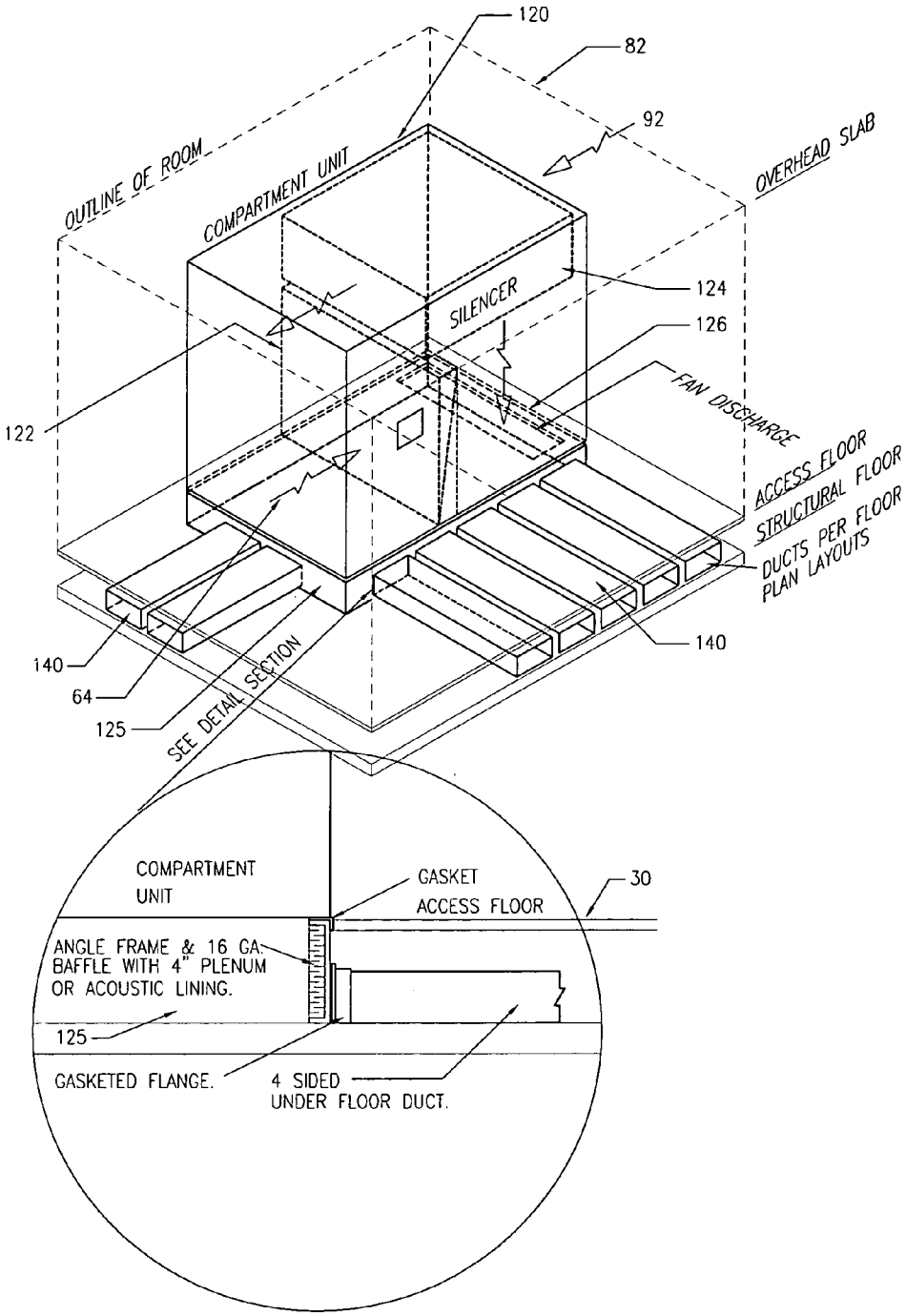
FIG. 4 is a representative view of a typical compartment unit ducting configuration.

The return damper assembly 90 also includes lower openings 94 as shown in FIG. 4 connected to the plenum 40 for receiving the remaining air 64 as previously described. The lower opening 94 can also include a smoke detector for detecting any smoke in the plenum 40.

The compartment unit air handling equipment 120 can also include a fan (shown in diagrammatic fashion and labelled SF [supply fan]) configured for under floor air design as typically known by those persons skilled in the art and with a discharge opening 126 for blowing air (combination of the portion of air 60 plus the remaining air 64) to the hollow core slabs 4 by means of a supply air plenum box 125 below the compartment units which is connected to conduits or ducts 140. The conduits or ducts 140 communicate with the fan means 80 and the inlet 12 of the slabs 4 for delivering of air through the passage 8 as previously described.

Alternatively just as the compartment unit 120 in FIG. 4 blows its supply air directly into a below floor plenum which feeds the below floor duct distribution system, supply duct from a remote AHU/fan system could connect to the same below floor supply air plenum. Furthermore, return air ducts from the same remote located fan system would only need to collect air from the building occupied floor plate space 62 by being open ended into a space such as a mechanical service room containing a return air damper assembly 90 or by directly connecting to the return air damper assembly 90. Accordingly, the invention described herein can be utilized with a plurality of locations and a plurality of air handlers and fans. Furthermore, the fan could even be located on a roof top in keeping with this invention; as is illustrated as an option in FIG. 3 as a dotted outline of a remote mechanical room, mechanical penthouse or roof location 85.

FIG. 2 shows one example of a typical floor plan for a floor 3 in a building 5. For example the floor 3 includes a number of elevators 7 as well as a mechanical or service room 82 having a compartment unit air handling equipment 120 which includes the return damper assembly 90 as previously described. The compartment unit includes the fan 80 which communicates with at least one duct 160. As shown in FIG. 4 the at least one duct 140 communicates with a number of concrete floor slabs 4 so as to define at least one hollow core concrete floor slab section 182. The at least one duct 140 communicates with the fan 80 at one end thereof. The other end of the at least one duct 140 communicates with the inlets 12 of each of the slabs 4 defining the at least one hollow concrete floor slab section 182 so as to deliver air to be circulated through the passage of the slabs. The air in the slabs 4 will then exit through the outlet 14 of each of the slabs 4 defining the at least one hollow core concrete floor slab section 182 as shown in FIG. 2.

FIG. 2 shows however that a plurality of ducts 140 are actually utilized as represented by numerals 160, 170, 180, 190, 200, 210, 220, 230, and 240. Each of these plurality of ducts can communicate with a plurality of hollow core concrete floor sections 165, 175, 185, 195, 205, 215, 225, 235 and 245.

The floor plan shown in FIG. 2 can include a plurality of rooms above each of the sections described above. Also, the under floor plenum 40 can be sectioned off to produce a corresponding number of floor plenums equal to the number of sections serviced by the plurality of ducts 140 as previously described. Typically however the rooms above the sections described above are done with partitions that rest on the raised floor surface 30.

While one can subdivide the building floor plate one does not need to take the partitions down to the surface of the hollow core to establish separate room control.

Temperature control of existing prior art systems include the management of the cooling capacity against the heat gains generated in the building. Typically these management systems consist of varying the amount of overhead supply air maintained at an appropriate temperature for cooling through use of a VAV box. In current generation underfloor air buildings, the adjustable but relatively constant cool temperature lightly pressurized plenum provides a reservoir for controlled groupings of automatic infloor terminals to open in an incremental or modulating fashion to deliver the quantity of cool air as necessary to balance the heat gains and maintain a set point temperature.

The invention described herein incorporates such features in the infloor terminals but in addition there is a combined radiant cooling effect and convective heat transfer absorptive capability of the hollow core slab above the space. Accordingly, temperature control can be done by adjustments to either or both the temperature and volume of the air from the floor plenum and/or the temperature of the slab above the room.

In one embodiment the surface temperature of the slab above the space could be kept relatively constant at for example 20° C. while the more quickly responding airstream aspect of the invention as described herein can be used for temperature control.

Accordingly, the individual room control can in one embodiment be accomplished from automatic infloor terminals that do not require partitioning down to the structural floor to separate the airstream of a given duct such as duct 160. In another embodiment however, a duct 160 could be utilized to serve a section such as section 165. The invention described herein allows for modulating damper 163 in the open position (normally closed). The air that would normally go through slabs in section 165 serves to take the path of least resistance and not go through the slab thereby reducing the airflow and charge of the slab but maintaining the airflow rate in the plenum.

Alternatively each floor may be conditioned as one unit whereby the air 60 being delivered to the space 62 on the floor 3 from all of the ducts 160, 170, 180, 190, 200, 210, 220, 230 and 240, is delivered to the entire floor ( without sectioning ) as one unit and recirculated back to the fan 80 as previously described. However, if the floor 3 is partitioned into a plurality of rooms as previously described, each of the hollow core concrete floor sections will support at least one raised one floor section, and at least one floor plenum will be defined between the at least one hollow core concrete floor sections and the at least one raised floor sections for communicating with the outlets 14 of each of the slabs 4 in the sections as previously described. In this way each of the at least one raised floor sections will include the terminal means 50 as previously described.

The terminal means 50 may include a manually adjustable type of terminal or diffuser 51 or automatic type of adjustable terminals 53. Adjustable terminals 53 are automatic control terminals being adjusted by a control system. The adjustable terminals 53 may be adjusted by motorized damper 55 on them which can open or close the diffuser or terminal in a manner well known to those persons skilled in the art so as to meet temperature set points by the Building Automation System (BAS). The motor operator 55 associated with the terminal 53 modulates in response via the control system to temperature in the space 62, opening or closing when above or below a temperature set point respectively. The motorized damper 55 of the automatic terminal 53 may receive an electric current signal from its controller to affect its open/closed portion. This is integrated into a typical monitoring and control Building Automation System (BAS) all known and familiar to persons skilled in the art.

Generally speaking the plenum pressure is operated at a relatively constant condition. Even with the plenum 40 pressure stable, opening adjustable terminal 53 will provide more air. If the plenum pressure is increased, the same degree of opening will give more air. An analog output from the Building Automation System (BAS) in volts or amps to the terminal 53 or motor operator 55 adjusts the degree of opening in a manner well known to people skilled in the art.

FIG. 5 shows that the system 70 can be used in a multi-storey building having a number of floors. FIG. 5 shows a first, second, third and fourth floor 112, 114, 116 and 118. The hollow core slabs 4 in the second floor 114 can gain heat from the air 60 in the space 62 which is below the slab. In other words the floor of one level in the building is the ceiling of the level below it.

Furthermore, as shown in FIG. 3, each of the ducts 140 include a normally closed motorized damper 163.

Upon start up the system, the following sequence of operations can occur by way of an example:

1. Upon the start up signal the fan will be started at a present low-speed as controlled by the variable speed drive (VSD) and the motorized dampers can start to move to a fully opened position to receive air only from the high level return air 92 and the constant volume terminal (CVT) can be opened to a preset volume as set on the control device (not shown). The CVT is a device to control fresh air requirement of a floor plate in a manner known to persons skilled in the art;
2. The volume of air flow can be increased by speeding up the fan using the VSD until the differential pressure (DP) set point (detected from the control device BUBBLED) is achieved. For example, the DP set point can be selected at 12.5 Pa to 24 Pa This DP set point is shown by way of an example only and can be selected at any level.
3. The motorized dampers 163 allow bypass of air in the slab, and effects the thermal charge in the slab. If the air bypasses the slab then some air ends up in the plenum so the pressure is largely unchanged in the plenum but it is cooler.
4. The speed of the fan 80 can have an adjustable volume to ensure necessary pressure in the plenum 40 and a minimum flow through the hollow core passage 8 at all times. The minimum speed on the fan will be defined by the limitations on the variable speed driver fan motor control system.
5. The cooling valve can be modulated to maintain the supply air temperature set point of a selected value such as for example 16° C.
6. The supply air temperature can be reset based on the return air temperature by sampling multiple return air sensors per compartment unit or space temperature sensors through the space all as typically done by those persons skilled in the art.
7. Upon sensing a high limit temperature, the supply fan 80 can be shut down and an alarm (BAS) can be activated and close down D1.
8. An under floor plenum temperature sensor can be provided for each area served by the compartment unit 120.

The system 70 can be charged at any time but preferably during non-office operating hours. If the system 70 is to be used to load cooling into the hollow core slabs 4, the following sequence can occur by way of example:

1. all automatic in floor air terminals 53 will be closed; generally speaking, good results will be achieved when the majority of infloor terminals are automatic.
2. by way of example the control device (not shown) can be adjusted to provide an operation such that high level return air louver or opening of return air grill 92 will receive 100% of the return air by opening damper 95 100% open and damper 96 100% closed. Alternatively, 100% of return can be returned through floor plenum 94 by closing motorized damper 95 100% and opening damper 96 100%. During the change cycle, the later position is used to return air through the floor plenum.
3. the supply fan 80 can be set to run at 100% for example;
4. the constant volume terminal (CVT) can be closed;
5. the chilled water valve can be opened through the cooling coil as shown in FIG. 3;
6. the system 70 can run until all embedded temperature sensors 165 meet the set point;
7. a plurality of static pressure sensors are located in the floor plenum 40 which will be monitored. Accordingly all differential static pressure sensors 67 will be monitored within the floor plenum 40 and the associated compartment unit 120 for the supply air flow.

The invention described herein provides equipment to allow a continuous volume of supply air through the hollow core slab 4 to optimize its thermal charge and convective and radiant cooling effect while at the same time allow the pressure control variable volume for the plenum 40 supply delivery as to be required of a current under floor air design. The invention described herein also allows maximum continuous mass thermal storage in the hollow core slab 4 while providing a variable air flow capability for proper control of the in floor supply plenum air released into the space to address varying cooling loads. The invention described herein is an advance over previous designs since:

1. previous designs required greater duct infrastructure in using both overhead duct work and vertical duct drops to get air into the supply air plenum;
2. using both overhead duct work and raised floor causes higher floor to floor heights and greater building planning and finishing costs;
3. the volume of air flow in the previous designs was varied in the hollow core slab passages 8 in response to air flow needed for the cooling load under temperature control.

The system 70 described herein can be used in combination in either:

1. central station air handling systems with supply and return ducts with branch duct take offs serving each floor and making supply air connections to the below floor plenum (s) 142 which connects to the plurality of below raised floor ducts 140, 160, 170 and return air connections to the return damper system device 90;
2. on floor compartment unit air handling systems typical of repetitive floor plate multi-storey buildings.

The invention described herein teaches a design where:

3. the air flow through the hollow core slab 4 is released to the raised floor cavity supply air plenum 40;
4. the duct work and control damper assembly and control sequence which enables the excess plenum supply air 64 (causing an overpressure condition as read by the pressure sensors in the floor plenum 40) is bypassed back to the fan 80 servicing the floor;
5. the damper control system on the infloor duct work is used to control the level of air flow (and thus thermal charge) in the hollow core slab system supporting the raised floor and effecting heat absorption from the occupied space below.

Moreover the invention described herein exhibits

1. Thermal storage and the radiant heat transfer and convective heat transfer absorptive capabilities of the thermal mass that apply to the slabs above the occupied space.
2. Ability to apply a continuous and adjustable air flow to the occupied space.

By utilizing the invention described herein one is able to reduce the size of the HVAC equipment and achieve improved energy efficiency.

The duct work and damper assembly is sized for the volumes of air applicable in a manner known to persons skilled in the art. The form of control systems that can be used typically comprise of Direct Digital Control (DDC) providing controlled manipulation of the dampers. The dampers 163 in return air damper assembly 90 (allows for bypass of the hollow core, as previously discussed) are set to modulate to maintain the pressure set point in the floor plenum. The combined quantity of air returned from the floor plenum (unused by the occupied volume) and the return air plenum, as controlled by the respective dampers represents the total volume delivered by the fan.

The equipment described herein can be applied to the combined application of integrated air flow hollow core structural slab type designs when applied in conjunction with integrated access floor (HVAC) system mounted above the slab 4 and the air flow in the hollow core slab 4 is released to the raised floor supply air plenum 40 above the hollow core structure.

Accordingly the design described herein illustrates a method of conditioning air through a hollow core medium supporting a raised floor comprising:

1. passing the air through the hollow core medium to effect relative heat exchange therebetween;
2. releasing the air from the hollow core medium into a floor plenum defined between the hollow core medium and the raised floor.

Also the apparatus, system and method can not only control or condition the temperature of the space 62 but can also be used to control and monitor other parameters or characteristics such as humidity and pressure .

Various embodiments of the invention have now been described in detail. Since changes in and/or additions to the above-described best mode may be made without departing from the nature, spirit or scope of the invention, the invention is not to be limited to said details.

I claim:

1. A heat exchange and ventilation system for at least one room on at least one floor in a building, comprising:

(a) at least one hollow core concrete floor section for thermal mass charging having an upper surface and a lower surface and an air passage therethrough with an inlet and outlet;

(b) at least one raised floor section supported by said upper surface of the at least one hollow core concrete floor section;

(c) at least one floor plenum defined between said upper surface of said at least one hollow core concrete floor section and said raised floor section for communicating with said outlet of said hollow core concrete floor section;

d) a return damper assembly having a return damper and a return air duct having an upper opening communicating with a space above the at least one raised floor section, and a lower opening communicating with said at least one floor plenum;

(e) fan means (f) duct means having one end communicating with said inlet of said air passage, and another end communicating with said at least one floor plenum;

(g) wherein said fan means moves air through said duct means to:

(i) selectively provide a first supply volume of air to said one end of said duct means communicating with said inlet of said air passage in said hollow core concrete floor section to provide heat exchange between said first supply volume of air and said at least one hollow core concrete floor section for thermal storage by the at least one hollow core concrete floor section and to exit said outlet of said air passage to said at least one floor plenum; and (ii) selectively provide a second supply volume of air to said another end of said duct means to said at least one floor plenum, to mix with said first supply volume of air that exits said outlet of said air passage to said at least one floor plenum to and plenum air;

(h) terminal means disposed in said raised floor section communicating with said at least one floor plenum and the space above the at least one hollow core floor section for presenting a selected volume of the plenum air to the space above the raised floor section;

(i) and wherein said fan means draws:

(i) a selected volume of said air in said space through said upper opening of said return damper assembly; and (ii) remaining volume of plenum air through said lower opening of said return damper assembly;

to re-circulate back to said duct means.

2. A heat exchange and ventilation system as claimed in claim 1 further including another said hollow core concrete floor section above the space.

3. A heat exchange and ventilation system as claimed in claim 2 wherein said terminal means is adjustable so asto present said selected volume of plenum air to the space above the raised floor section.

4. A heat exchange and ventilation system as claimed in claim 3 including at least one duct means communicating with at least one said fan means and said inlet of said at least one hollow core concrete floor section.

5. A heat exchange and ventilation system as claimed in claim 3 including a plurality of hollow core concrete floor sections and a plurality of duct means respectively communicating with said fan means and said plurality of hollow core concrete floor sections, respectively.

6. A heat exchange and ventilation system as claimed in claim 5 wherein each said plurality of duct means includes a supply air outlet damper at said other end, said damper biased in the closed position.

7. A heat exchange and ventilation system as claimed in claim 1 where in said raised floor sections defines one floor plenum.

8. A heat exchange and ventilation system as claimed in claim 5 including an adjustable supply air outlet damper at said other end of said duct meats to move from a biased closed position, whereby said at least one floor plenum is supplied by said first supply volume of air, to an open position whereby said at least one floor plenum is supplied by both first and second supply volume of air.

9. A heat exchange and ventilation system as claimed in claim 1 including temperature sensor means disposed in said floor plenum, and further including differential pressure sensors for controlling the return damper assembly.

10. A heat exchange and ventilation system as claimed in claim 9 further including means on said duct means for controlling the level of air flow in said hollow core concrete floor segments to control said heat exchange.

11. An air conditioning system between spaced hollow core slabs defining a floor and ceiling:

(a) each hollow core slab for thermal storage having an air passage therethrough with an inlet and outlet for receiving air and permitting relative heat exchange between the air and the hollow core slab;

(b) one of said hollow core slabs defining said ceiling and providing a radiant heat exchange surface to a space below the ceiling;

(c) the other one of said hollow core slab defining said floor supporting a raised floor defining a floor plenum between, the hollow core slab and said raised floor, said floor plenum communicating with said outlet of said air passage in the other one of said hollow core slabs;

(d) a return damper assembly having a return damper and a return air duct having a first opening communicating with a space above the raised floor of the other one of said hollow core slab, and a second opening communicating with said floor plenum;

(e) fan means for moving air through said air passage of said one of said hollow core slab defining said ceiling to provide said radiant heat exchange to the space below the ceiling;

(f) duct means having one end communicating, with said inlet of said air passage in the other one of said hollow core slabs defining said floor, and another end communicating with said floor plenum;

(g) wherein said fan means moves air through said duct means to:

(i) selectively provide a first supply volume of air to said one end of said duct means communicating with said inlet of said air passage in said other one of said hollow core slab to provide heat exchange between said first supply volume of air and said other one of said hollow core slab for thermal storage by the other one of said hollow core slab and to exit said outlet of said air passage to said floor plenum; and (ii) selectively provide a second supply volume of air to said another end of said duct means to said floor plenum, to mix with said first supply volume of air that exist said outlet of said air passage to said floor plenum to define plenum air;

(h) terminal means disposed in said raised floor section communicating with the floor plenum and the space above the other one of the hollow core slab for presenting a selected volume of the plenum air to the space above the raised floor;

(i) and wherein said fan means draws:

(i) a selected volume of said air in said space above the raised floor through said first opening of said return damper assembly; and remaining volume of plenum air through said second opening of said return damper assembly;

to re-circulate back to said duct means.

12. An air conditioning system as claimed in claim 11 wherein said terminal means is adjustable so as to present said selected volume of plenum air to the space above the raised floor.

13. An air condition system as claimed in claim 12 including differential pressure sensors for controlling the return damper assembly.

14. An air condition system as claimed in claim 13 wherein said terminal means is adjustable to deliver a selected volume of plenum air to the space above the raised floor section from 0 to 100%.

15. An air conditioning system as claimed in claim 14 where said return damper assembly means is disposed generally vertically relative said raised floor.

16. An air conditioning system comprising:

(a) a hollow core slab for thermal mass charging having an upper surface and a lower surface and an air passage therethrough with an inlet and outlet;

(b) a raised floor supported by said upper surface of the hollow core slab;

(c) a floor plenum defined between said upper surface of the hollow core slab and the raised floor for communicating with said outlet of said hollow core slab (d) a return damper assembly having a return damper and a return air duct having an upper opening communicating with a space above the raised floor, and a lower opening communicating with said floor plenum;

(e) a fan;

(f) a duct having one end communicating with said inlet of said air passage, and another end communicating with said floor plenum;

(g) wherein said fan moves air through said duct to:

(i) selectively provide a first supply volume of air to said one end of said duct communicating with said inlet of said air passage in said hollow core slab to provide heat exchange between said first supply volume of air and said hollow core slab for thermal storage by the hollow core slab and to exit said outlet of said air passage to said floor plenum; and (ii) selectively provide a second supply volume of air to said another end of said duct to said floor plenum, to mix with said first supply volume of air that exist said outlet of said air passage to said floor plenum to define plenum air;

(h) a terminal disposed in said raised floor section communicating with said floor plenum and the space above the raised floor for presenting a selected volume of the plenum air to the space above the raised floor;

(i) and wherein said fan draws:

(i) a selected volume of said air in said space through said upper opening of said return damper assembly; and (ii) remaining volume of plenum air through said lower opening of said return damper assembly;

to re-circulate back to said duct means.

* * * * *